United States Patent [19]

Ernst

[11] 4,381,762

[45] May 3, 1983

[54] FRICTION FURNACE

[76] Inventor: Arnold E. Ernst, Wolverton, Minn. 56594

[21] Appl. No.: 203,467

[22] Filed: Nov. 3, 1980

[51] Int. Cl.[3] ..... F24C 9/00

[52] U.S. Cl. ..... 126/247; 122/26; 165/96; 165/DIG. 5

[58] Field of Search ..... 126/247; 122/26; 165/96, DIG. 5, 122

[56] References Cited

U.S. PATENT DOCUMENTS

| | | | |
|---|---|---|---|
| 823,856 | 6/1906 | Gilroy | 126/247 |
| 1,682,102 | 8/1928 | Allen | 126/247 |
| 3,164,147 | 1/1965 | Love et al. | 126/247 |
| 3,402,702 | 9/1968 | Love | 126/247 |
| 3,813,036 | 5/1974 | Lutz | 126/247 |
| 4,004,553 | 1/1977 | Stenstrom | 126/247 |
| 4,185,688 | 1/1980 | Wiater et al. | 165/122 |
| 4,285,329 | 8/1981 | Moline | 126/247 |

FOREIGN PATENT DOCUMENTS

| | | | |
|---|---|---|---|
| 52-7044 | 1/1977 | Japan | 126/247 |

*Primary Examiner*—Samuel Scott
*Assistant Examiner*—Margaret A. Focarino
*Attorney, Agent, or Firm*—Henderson & Sturm

[57] ABSTRACT

A friction furnace having a casing and containing a plurality of orifice plates disposed therein. The orifice plates are of two types arranged in alternating order throughout the casing; each type of orifice plate, however, having an annular ring disposed radially inward from its periphery which contains a plurality of radially disposed passages. The first type of orifice plate contains a plurality of transverse passages disposed between its periphery and annular ring whereas the second type of orifice plate contains a plurality of transverse passages disposed entirely within the diameter of its annular ring. An adjusting means is provided for varying the number of orifice plates contained within the casing. Fluid is circulated throughout the friction furnace through and around the orifice plates by a pump; and, a heat exchanger is provided in fluid communication with the furnace to transfer the heat of the circulating fluid to a directionally controlled flow of air.

5 Claims, 9 Drawing Figures

FRICTION FURNACE

BACKGROUND OF THE INVENTION

The present invention relates generally to an apparatus for heating fluids and more particularly to a friction furnace for heating circulating fluid.

There have been many attempts to provide a suitable device for heating fluids of a general type within which fluid is frictionally heated under forced circulation. Examples of such devices are shown in U.S. Pat. Nos. 823,856; 1,682,102; 3,164,147; and 4,004,553. U.S. Pat. Nos. 1,682,102; 3,164,147; and 4,004,553 are typical of the prior art in that they utilize a rotating means to induce friction in a fluid contained within the device. For example, U.S. Pat. No. 1,682,102 heats air within a casing by rotation of a plurality of paddle wheels alternately disposed in close proximity to a plurality of stationary partitions. Rotation of the paddle wheels creates compressive friction and turbulance in the fluid (air) which is then translated into heat.

Alternatively, U.S. Pat. No. 3,164,147 teaches rotation of rigid discs adjacently disposed and in contact with stationary discs such that the relative motion of the discs causes frictional heating thereof. Oil is then circulated within the discs in order to absorb and transfer this heat for external use. Similarily, U.S. Pat. No. 4,004,553 teaches the use of a rotating disc disposed in a narrow interspace within a housing. Fluid circulating through the device is heated by the rotational turbulence created therewithin.

Common to these examples of prior art, however, is the necessity for not only rotational motive force applied to the device but also the application of force to displace the fluid through the device. Such displacive force is provided in U.S. Pat. No. 1,682,102 by internal impeller wheels driven by the rotating means whereas in U.S. Pat. Nos. 3,164,147 and 4,004,553, displacive force is provided by external means. Unfortunately, high speed rotating devices built to close tolerance, as dictated by the nature of the prior art, are inherently expensive in both manufacture and operation and necessary coupling of a fluid displacive means only further complicates this art. Consequently, there is a need for a friction furnace which eliminates the need for rotating elements, thus simplifying manufacture as well as reducing the cost of operation and maintenance of such devices.

Another problem inherent in the friction furnace art is an inability to readily adapt a particular device to increase or decrease its heating capability in order to meet the needs of each particular application. U.S. Pat. No. 3,164,147 is typical as such in that modification of the device necessitates replacement of the rotating means in order to achieve higher rotational speeds and/or insertion of additional internal rotating devices thus necessitating extensive modification and/or replacement of the original casing. U.S. Pat. No. 4,004,553, for example, teaches the use of a plurality of component modules installed in series to achieve higher fluid heating values but this art also necessitates extensive modifications not readily adapted to each particular application. Consequently, there is an additional need for a friction furnace which may be readily adapted for increased and/or decreased heating demands of each particular application.

U.S. Pat. No. 823,856 presents one solution to these problems of rotational complexity and adaptability.

However, the corrugated plates used therein severely restrict the adaptability of that device since the number of plates is limited by their necessarily concentric design. Additionally, these plates require extensive and costly machining of minute perforations in order to achieve the desired heating effect upon transversing air.

An additional problem found to be common in the prior art utilizing a circulating liquid, is the operational necessity to maintain internal fluid pressures of 1200 psi or greater. Such pressures, unfortunately, greatly increase the cost of manufacture and operation of the systems.

As a result, there is a need for a friction furnace which eliminates the costly necessity for both rotating and circulating means; is inexpensive to manufacture and operate; is simple and relatively uncomplicated in design; can be readily adapted to meet the heating requirements of a particular application; and can effectively operate at design pressures less than 1200 psi.

SUMMARY OF THE INVENTION

The present invention relates to a friction furnace having a casing and containing a plurality of orifice plates disposed therein. The orifice plates are of two types arranged in alternating order throughout the casing; each type of orifice plate, however, having an annular ring disposed radially inward from its periphery which contains a plurality of radially disposed passages. The first type of orifice plate contains a plurality of transverse passages disposed between its periphery and annular ring whereas the second type of orifice plate contains a plurality of transverse passages disposed entirely within the diameter of its annular ring. An adjusting means is provided for varying the number of orifice plates contained within the casing. Fluid is circulated throughout the friction furnace through and around the orifice plates by a pump and a heat exchanger is provided in fluid communication with the furnace to transfer the heat generated in the circulating fluid to a directionally controlled flow of air.

An object of this invention is to provide an improved friction furnace.

Another object of this invention is to provide a friction furnace of simple and economical design which eliminates the need for a rotating mechanism.

A further object of this invention is to provide a friction furnace which uses adaptable orifice plates of a common design to generate heat in a circulating pressurized fluid.

A still further object of this invention is to provide a friction furnace which can be readily adapted for increased heating capacity.

An additional object of this invention is to provide a heat exchanger which can be readily adjusted to maximize heat transfer to a directionally controlled volume of air.

Other objects, advantages, and novel features of the invention will become apparent from the following detailed description of the invention when considered in conjunction with the accompanying drawings.

DESCRIPTION OF THE PREFERRED EMBODIMENT

Figure 6:
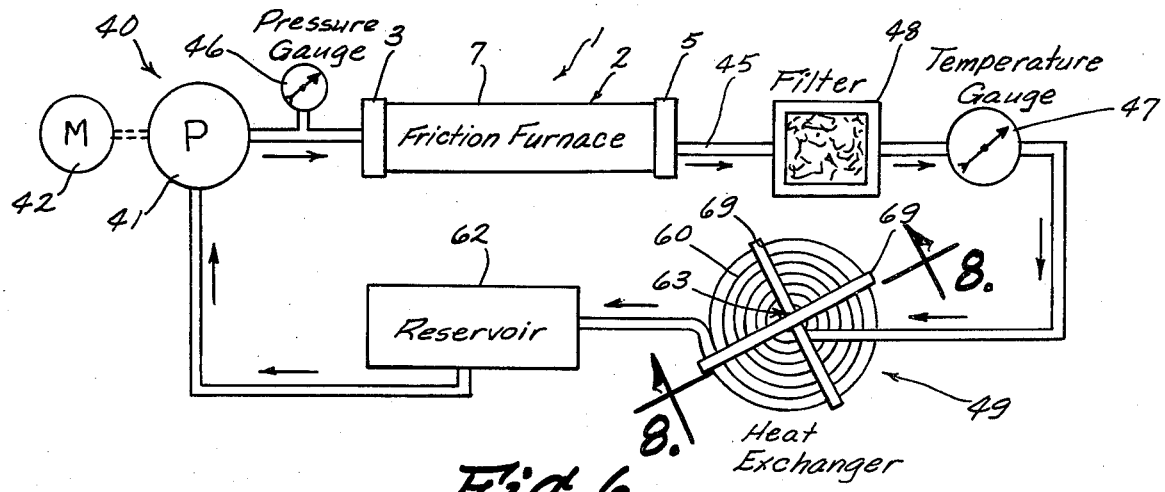
FIG. 6 is a schematic view showing the friction furnace used in combination with a coiled tube heat exchanger.

Referring now to the drawings, wherein like reference numerals designate identical or corresponding parts throughout the several views, FIG. 6 shows the general elements of the invention comprising a friction furnace 1, a pumping means 40, and a heat exchanger 49.

Figures 1, 2, 3, 4, 5:
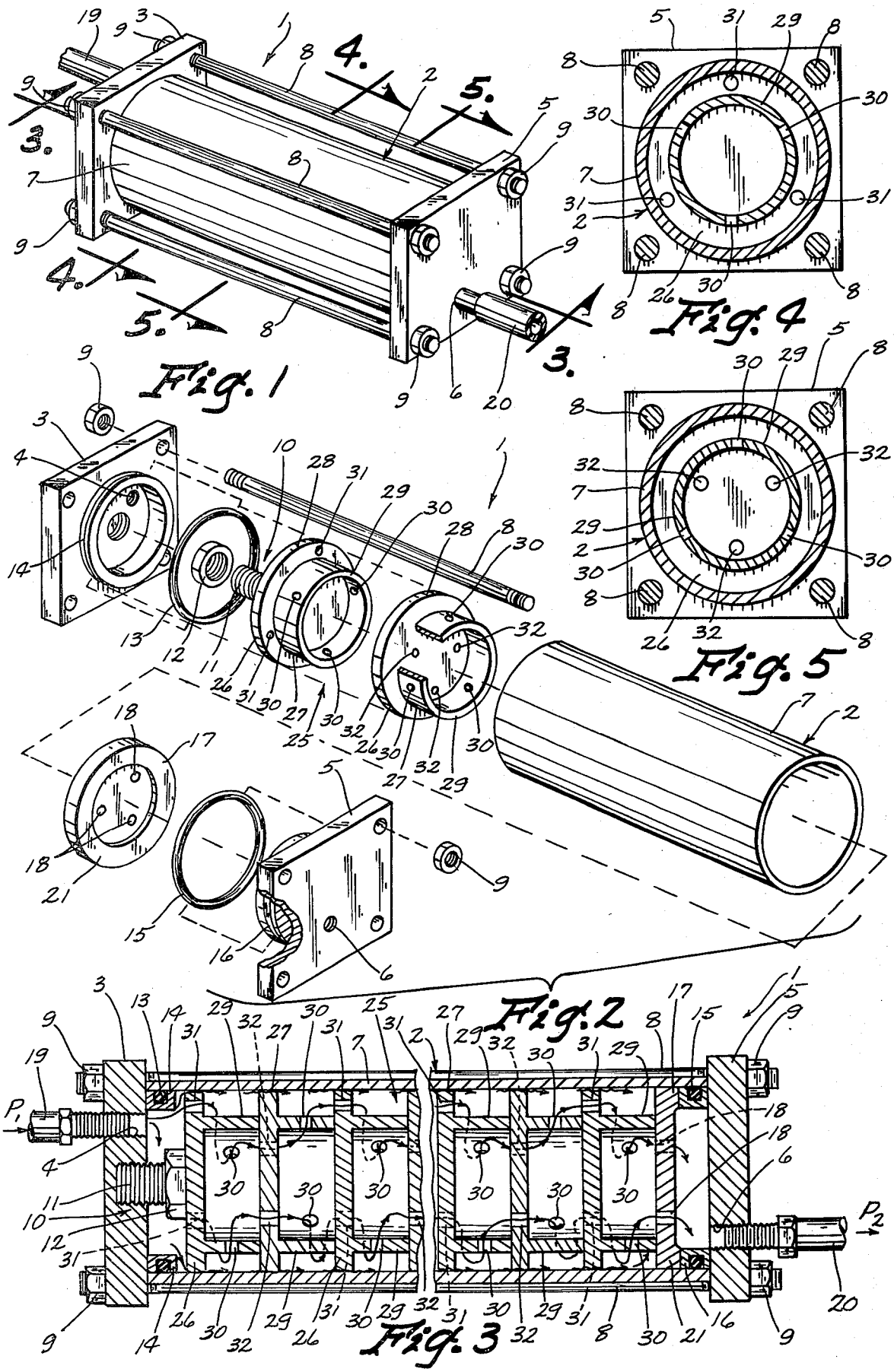
FIG. 1 is a perspective view showing the exterior structure of the friction furnace of the present invention.
FIG. 2 is an exploded perspective view showing the individual elements and construction of the friction furnace.
FIG. 3 is a sectionl view taken along line 3—3 of FIG. 1, showing the flow pattern of hydraulic fluid through the friction furnace.
FIG. 4 is a sectional view taken along line 4—4 of FIG. 1, showing a first orifice plate including fluid flow orifices in the portion of the disc disposed radially outward from the annular ring.
FIG. 5 is a sectional view taken along line 5—5 of FIG. 1, showing a second orifice plate including fluid flow orifices in the portion of the disc disposed radially inward from the annular ring.

The friction furnace 1, as shown in FIGS. 1, 2, and 3, is comprised of a casing 2 an adjusting means 10 and orifice plates, generally indicated at 25. An inlet endcap 3 contains a fluid inlet 4 in which is threaded an inlet fitting 19. The outlet endcap 5 contains the fluid outlet 6 in which an outlet fitting 20 is similarily threaded. A cylindrical housing 7 is disposed between the inlet endcap 3 and the outlet endcap 5 and is rigidly secured in place by a plurality of threaded connecting rods 8 and threaded fasteners 9, which are securely positioned thereon.

A plurality of orifice plates, generally indicated at 25, is disposed within the cylindrical housing 7. These orifice plates 25 are of two types, 26 and 27. Common to each of these two types of orifice plates is a disc 28 sized so as to maintain the disc 28 in peripheral, non-sealing contact with the cylindrical housing 7. Rigidly attached to each disc 28 and disposed radially inward from the periphery thereof is an annular ring 29 containing a plurality of annular ring passages 30 radially disposed therein. FIGS. 4 and 5 show a cross-sectional view of an annular ring 29 with a typical disposition of annular ring passages 30. The first type of orifice plate 26 contains a plurality of transverse passages 31 disposed between its periphery and annular ring 29. FIG. 4 shows a typical disposition of these transverse passages 31 within this first type of orifice plate 26. The second type of orifice plate 27 contains a plurality of transverse passages 32 disposed entirely within the diameter of its annular ring 29 as shown in FIG. 5. In construction of each type of orifice plate 26 and 27 the annular ring passages 30 and the transverse passages 31 and 32 are angularly offset from one another so as to promote turbulent fluid flow through the passages.

FIG. 3 shows a typical, alternating disposition of orifice plates of type 26 and 27 arranged within the cylindrical housing 7. In order to accommodate a varying number of orifice plates and thereby increase the heating capability of the friction furnace, an adjusted means comprising an adjusting assembly, generally indicated at 10, and adapter plate 21 are further contained within the cylindrical housing 7. The adjusting assembly is comprised of a threaded spacer 11 threadably secured to the input endcap 3 and upon which is threaded an adjusting nut 12. The adapter plate 21 is comprised of a peripheral adapter plate annular ring 17 and a plurality of transverse passages 18 radially disposed within the diameter of the adapter plate annular ring 17. The adapter plate 21 is disposed within the cylindrical housing 7 such that the adapter plate annular ring 17 is maintained in non-sealing contact with the output seal retaining ring 16. In assembly, as shown in FIG. 3, the adjusting assembly 10 is used to maintain a plurality of orifice plates 25, compacted against the adapter plate 21 by rotating the adjusting nut 12 tightly against the orifice plate 25. Additional orifice plates 25 can readily be added to the friction furnace 1 by utilizing a lengthened cylindrical housing 7 and inserting additional orifice plates 25 of types 26 and 27 in alternating fashion as shown in FIG. 3.

A sealing means comprised of the forward seal 13 positioned within an input seal retaining ring 14 and maintained thereby in peripheral, sealing contact with the cylindrical housing 7 and a rear seal similarily positioned within the output seal retaining ring 16 sealingly contains the fluid within the casing 2. As shown by the dashed line directional arrows in FIG. 3, in operation, fluid flows through the friction furnace 1 via the fluid inlet 4, through and around the plurality of orifice plates 25 via passages 30,31 and 32 disposed therein, and exits the adaptor plate passages 18 and fluid outlet 6.

Figure 7:
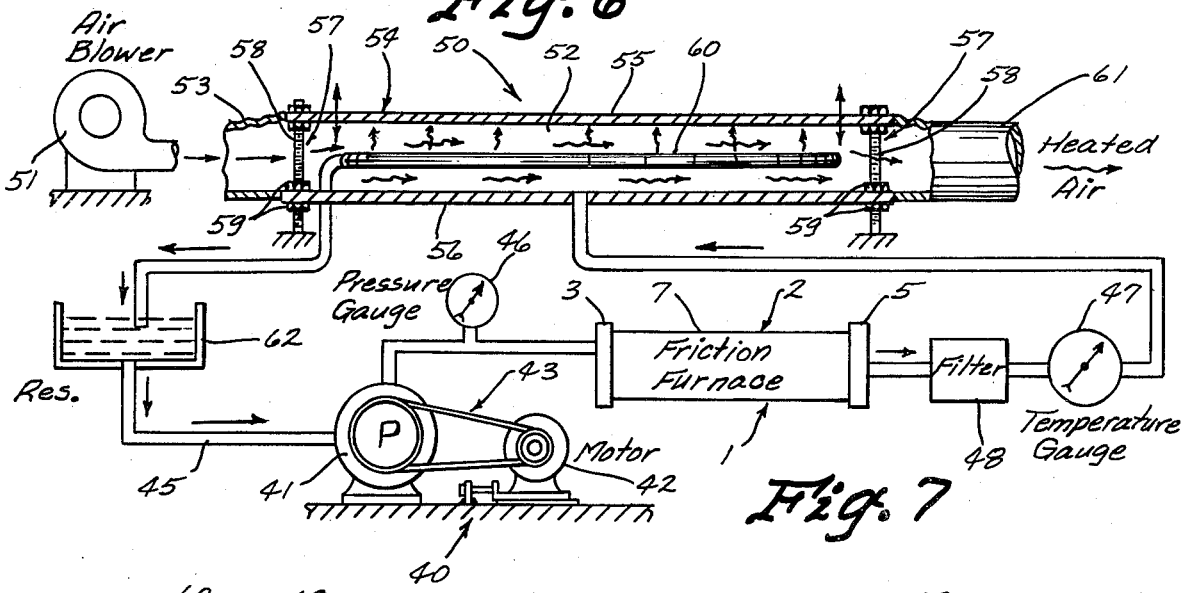
FIG. 7 is a schematic view showing the friction furnace used in combination with a coil tube heat exchanger disposed in an adjustable baffle assembly which provides variable air velocity.
Figure 8:
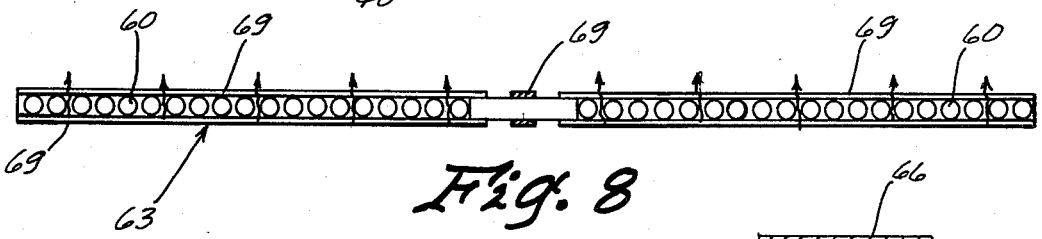
FIG. 8 is a sectional view taken along line 8—8 of FIG. 6 showing the coiled tube heat exchanger.

The pumping means 40 is comprised of the pump 41 operably connected to a motor 42 and being in fluid communication with the friction furnace 1 via rigid piping 45. Fluid is circulated in a circuitous fashion through the friction furnace 1 to a reservoir 62 disposed upstream of the pump 41. Pressurized turbulent flow of a fluid such as hydraulic fluid through the friction furnace 1 thereby generates heat which may be transferred for heating purposes through a heat exchanger generally indicated at 49 which is disposed in fluid communication with the friction furnace 1 and pumping means 40. Several types of heat exchangers 49 may be utilized for this purpose; one variety of heat exchanger 50, as shown in FIG. 7, is comprised of a heating chamber 52, a blower 51 disposed so as to displace air in the controlled path through the heating chamber 52, and a heating coil 60 disposed within the heating chamber 52 and in fluid communication with the friction furnace 1 and pumping means 40. The heating chamber shown in FIG. 7 includes a flexible air inlet 53 and a flexible air outlet 61 with an adjustable baffle assembly 54 disposed between the inlet 53 and outlet 61. This adjustable baffle assembly 54 is comprised of an upper baffle 55 and a lower baffle 56 operably connected by a baffle adjusting means 57. The baffle adjusting means 57 being comprised of a plurality of threaded connecting shafts 58 and a plurality of baffle adjusting nuts 59 may be operated so as to adjust the relative positions of the upper baffle 55 and lower baffle 56 and thereby vary the velocity of air within and discharged from the heating chamber 52. Air flow therefore within this heat exchanger 50 travels in a controlled path parallel to the heating coil 60 disposed within the heating chamber 52.

Figure 9:
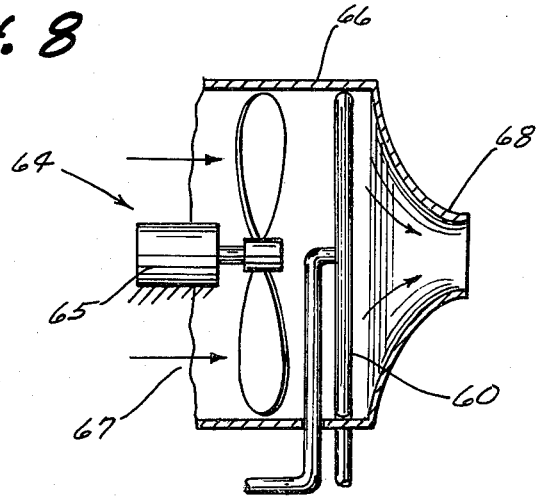
FIG. 9 is a side-elevational view in section showing an alternate heating chamber assembly utilizing a coiled tube heat exchanger.

Alternatively, FIG. 9 shows another example of a heat exchanger 64 which includes a bladed fan 65 disposed within a rigid duct assembly 66 and positioned upstream of the heating coil 60 such that the flow of air across the heating coil 60 is perpendicular thereto. The outlet 68 of this heating chamber 64 is substantially smaller in diameter than the air inlet 67 so as to create a venturi effect and thereby increase the velocity of discharged air. An optional coil brace 63 comprising rigid supports disposed on each side of the heating coil 60 may be used to maintain the heating coil 60 in a horizontal or vertical plane.

Operationally, the friction furnace components should be constructed so as to withstand medium pressures of approximately 600 psi. Additionally, the pumping means 40 should be selectively sized so as to provide complete circulation of fluid within the friction furnace 1 and heat exchanger 49 approximately five times per minute. Within these general perameters, the approximate differential temperature at the fluid inlet 4 and the fluid outlet 6 should therefore be 30° F. which may then be transferred for heating purposes by the heat exchanger 49. Additionally, a pressure gage 46 and temperature gage 47 may be operably disposed in the piping 45 and in fluid communication with the pump 41 and friction furnace 1 in order to display operating parameters of the invention.

Obviously many modifications and variations of the present invention are possible in light of the above teachings. It is therefore to be understood that, within the scope of the appended claims the invention may be practiced otherwise than as specifically described.

I claim:

1. A friction furnace comprising:

a casing, including an input endcap including a fluid inlet and an output endcap including a fluid outlet;

a plurality of orifice plates disposed within said casing, each of said orifice plates being in peripheral, non-sealing contact with said casing and having an annular ring disposed radially inward from the periphery of said orifice plate, said annular ring containing a plurality of radially disposed passages therethru; and an adjusting means for varying the number of said orifice plates contained within said casing, said adjusting means including:

an adjusting assembly including an adjusting nut and a threaded spacer threadably connected to said inlet endcap;

an adapter plate having an annular ring disposed at its periphery and containing a plurality of transverse passages disposed between its annular ring and its centerpoint, said adapter plate being disposed within said casing such that its annular ring is in contact with said outlet endcap.

2. A friction furnace comprising:

a casing, including an input endcap including a fluid inlet and an output endcap including a fluid outlet;

a plurality of orifice plates disposed within said casing, each of said orifice plates being in peripheral, non-sealing contact with said casing and having an annular ring disposed radially inward from the periphery of said orifice plate, said annular ring containing a plurality of radially disposed passages therethru;

an adjusting means for varying the number of said orifice plates contained within said casing;

means for pumping a fluid in a circuit throughout said friction furnace; said pumping means comprising:

a pump;

a motor, operably connected to said pump; and a fluid reservoir disposed upstream of said pump and in fluid communication therewith;

a heat exchanger fluidly connected to said friction furnace and said pumping means; said heat exchanger comprising:

a heating chamber wherein said heating chamber is comprised of:

an air inlet;

an air outlet; and an adjustable baffle assembly disposed between said air inlet and said air outlet and enclosing said heating coil;

a blower means for displacing air in a controlled path through said heating chamber; and a heating coil disposed within said heating chamber and fluidly connected to said friction furnace and said pumping means.

3. The friction furnace assembly as described in claim 2, wherein said adjustable baffle assembly is comprised of:

an upper baffle;

a lower baffle; and a means for adjusting the relative positions of said upper and said lower baffles.

4. The friction furnace as described in claim 3, wherein said baffle adjusting means comprises:

a plurality of threaded connecting shafts disposed between said upper and said lower baffles; and a plurality of baffle adjusting nuts threaded upon said connecting shafts and disposed on each side of said baffles.

5. The friction furnace as described in claim 3, wherein said heating coil is disposed within said heating chamber in a transverse manner, parallel to said upper baffle and said lower baffle such that air displaced through said heating chamber travels transversely across said heating coil.

* * * * *